US009339124B2

(12) United States Patent
Carter et al.

(10) Patent No.: US 9,339,124 B2
(45) Date of Patent: May 17, 2016

(54) CONVERTIBLE TEMPERATURE-CONTROLLED DISPLAY CASE

(71) Applicant: Hill Phoenix, Inc., Conyers, GA (US)

(72) Inventors: William J. Carter, Keosauqua, IA (US); David W. Hoaglin, Hillsboro, IA (US)

(73) Assignee: Hill Phoenix, Inc., Conyers, GA (US)

( * ) Notice: Subject to any disclaimer, the term of this patent is extended or adjusted under 35 U.S.C. 154(b) by 445 days.

(21) Appl. No.: 13/854,503

(22) Filed: Apr. 1, 2013

(65) Prior Publication Data

US 2013/0269541 A1 Oct. 17, 2013

Related U.S. Application Data

(60) Provisional application No. 61/623,415, filed on Apr. 12, 2012.

(51) Int. Cl.

| | |
|---|---|
| ***A23C 3/02*** | (2006.01) |
| ***A47F 3/00*** | (2006.01) |
| ***F25B 29/00*** | (2006.01) |
| ***A47F 3/04*** | (2006.01) |
| *A47F 10/06* | (2006.01) |

(52) U.S. Cl.

CPC ..... *A47F 3/001* (2013.01); *A47F 3/007* (2013.01); *A47F 3/0469* (2013.01); *A47F 3/0482* (2013.01); *F25B 29/00* (2013.01); *A47F 10/06* (2013.01); *Y10T 29/49826* (2015.01)

(58) Field of Classification Search

CPC ..... A47F 10/06; A47F 3/001; A47F 3/007; A47F 3/0469; A47F 3/0482; F25B 29/00; Y10T 29/49826

USPC ..... 99/483; 29/428; 312/138.1, 236; 62/246, 255, 258, 407, 440

See application file for complete search history.

(56) References Cited

U.S. PATENT DOCUMENTS

| | | | | |
|---|---|---|---|---|
| 2,518,134 | A * | 8/1950 | Fredenhagen | A47F 3/0413 312/116 |
| 3,327,700 | A * | 6/1967 | Macaulay | 126/191 |
| 8,973,385 | B2 * | 3/2015 | Swofford | A47F 3/0456 62/222 |
| 2002/0166462 | A1 * | 11/2002 | McMahon et al. | 99/483 |
| 2004/0244396 | A1 * | 12/2004 | Lane | A47F 3/0456 62/246 |
| 2007/0277539 | A1 * | 12/2007 | Kim | A47F 3/0447 62/153 |

* cited by examiner

*Primary Examiner* — Dana Ross
*Assistant Examiner* — Joseph Iskra
(74) *Attorney, Agent, or Firm* — Foley & Lardner LLP

(57) ABSTRACT

A temperature-controlled display case is convertible between a full-service mode and a self-service mode and defines a temperature-controlled space therein. A base has a back side and a front side and supports temperature-controlled food products within the temperature-controlled space. A back frame is coupled adjacent to the back side of the base and provides one or more openings for back-side access to the food products during the full-service mode. A top frame is supported by the back frame and a linkage has one end pivotally coupled to the top frame. A front panel has a top portion pivotally coupled to the linkage and is movable between a deployed position for the full-service mode with the front panel adjacent to the front of the base, and a stowed position for the self-service mode with the front panel disposed atop the top frame to provide front-side access to the food products.

17 Claims, 5 Drawing Sheets

CONVERTIBLE TEMPERATURE-CONTROLLED DISPLAY CASE

CROSS-REFERENCE TO RELATED APPLICATION

This application claims the benefit of priority to U.S. Provisional Patent Application No. 61/623,415, which was filed on Apr. 12, 2012, the complete disclosure of which is incorporated by reference herein.

FIELD

The present disclosure relates generally to the field of temperature-controlled display devices (e.g. refrigerated display cases, heated food service cases, combined cases having both refrigerated and heated food storage and display capability, etc.). More specifically, the present disclosure relates to a temperature-controlled case that is convertible between a full-service mode/configuration and a self-service mode/configuration. Still more specifically, the present disclosure relates to a convertible temperature-controlled case where a front panel is movable between a deployed position in front of the case during the full-service mode and a retracted (or stowed) position above the case during the self-service mode.

BACKGROUND

This section is intended to provide a background or context to the invention recited in the claims. The description herein may include concepts that could be pursued, but are not necessarily ones that have been previously conceived or pursued. Therefore, unless otherwise indicated herein, what is described in this section is not prior art to the description and claims in this application and is not admitted to be prior art by inclusion in this section.

It is well known to provide a temperature controlled display device such as a refrigerator, freezer, refrigerated merchandiser, refrigerated display case, etc., that may be used in commercial, institutional, and residential applications for storing or displaying refrigerated or frozen objects. For example, it is known to provide full-service type refrigerated display cases for displaying fresh food products such as beef, pork, poultry, fish, etc. Such display cases typically have a closed front (e.g. with rear doors or openings for back-side access to the food products within the temperature controlled space by service personnel at a customer's request). It is also known to provide self-service type refrigerated cases that typically have an open-front to permit convenient front-side access directly by customers and that uses a flow of chilled air that is discharged across the open front of the case to help maintain a desired temperature within the temperature-controlled space. However, such full-service and self-service type cases do not generally provide a merchant (e.g. supermarket, food-retailer, etc.) with the desired flexibility or versatility of converting a case between a full-service mode and a self-service mode of operation.

SUMMARY

One embodiment of the disclosure relates to a temperature-controlled display case that is convertible for operation in both a full-service mode and a self-service mode. The temperature-controlled display case defines a temperature-controlled space therein and includes a base having a back side and a front side to support temperature-controlled food products within the temperature-controlled space. A back frame is coupled adjacent to the back side of the base and provides one or more openings configured to provide back-side access to the food products during the full-service mode. A top frame is supported by the back frame and a linkage has one end pivotally coupled to either the back frame or the top frame. A front panel has a top portion pivotally coupled to an opposite end of the linkage and is movable in association with the linkage between a deployed position for the full-service mode with the front panel adjacent to the front side of the base, and a stowed position for the self-service mode with the front panel disposed atop the top frame to provide front-side access to the food products.

BRIEF DESCRIPTION OF THE DRAWINGS

Exemplary embodiments will hereafter be described with reference to the accompanying drawings, wherein like numerals denote like elements.

DETAILED DESCRIPTION

Figure 1:
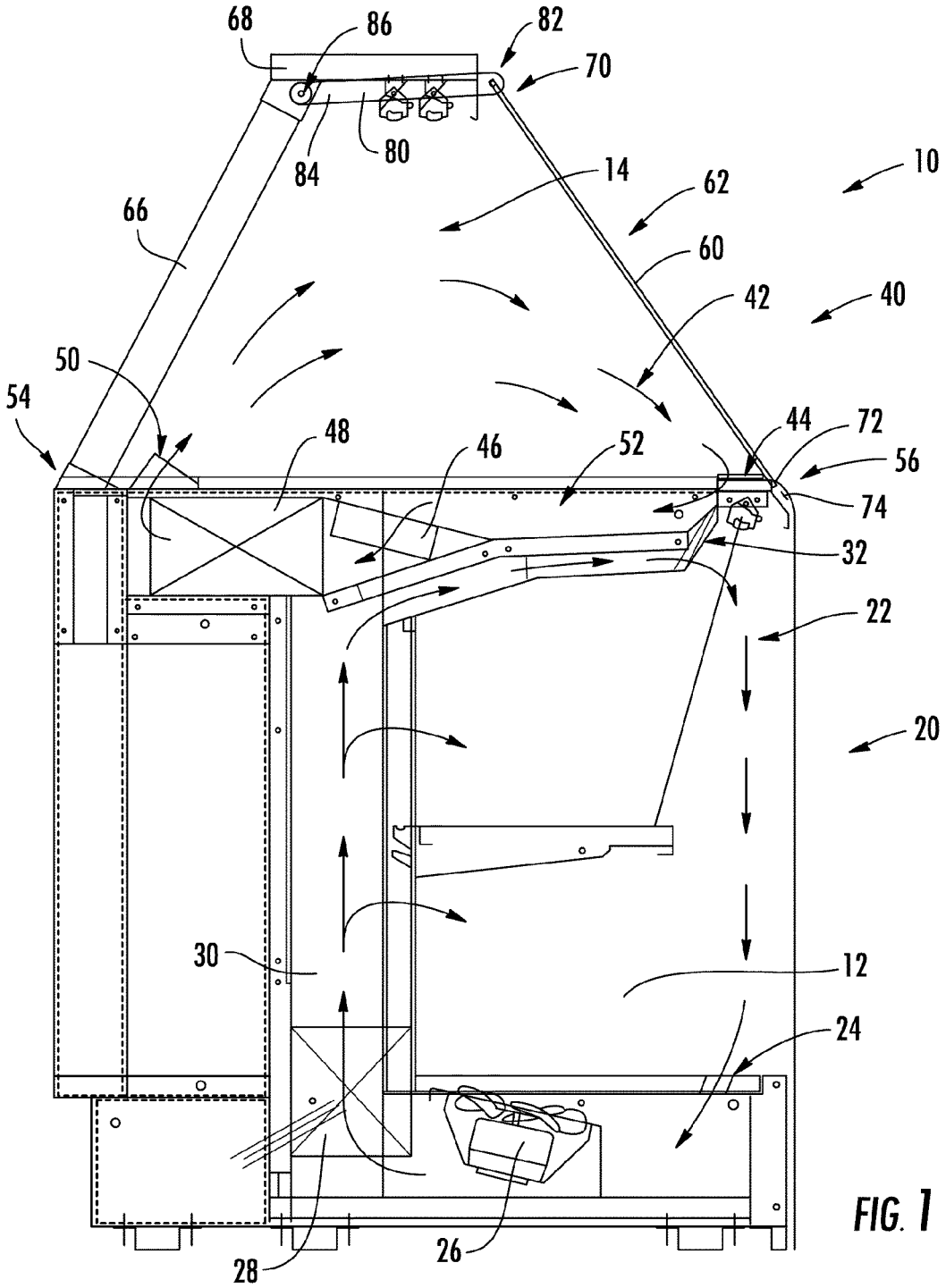
FIG. 1 is a schematic image of a side elevation view of a convertible temperature-controlled display device having a front panel disposed in a fully-deployed position corresponding to use in a full-service mode of operation, according to an exemplary embodiment.

Referring to the FIGURES, a convertible temperature-controlled display device 10 is shown according to an exemplary embodiment as having a 'stacked' configuration with a first lower portion 20 and a second upper portion 40 supported on the lower portion 20. As shown by way of example in the illustrated embodiment, the lower portion 20 includes first refrigeration system components providing a first air-flow pattern 22 for the flow of refrigerated air that is drawn in through a return opening 24 by a first fan 26 and discharged through a first cooling coil 28 (e.g. evaporator, etc.) into a duct or plenum 30 and distributed through a plurality of openings into a first temperature controlled space 12 and through an upper duct opening 32 to form an air curtain of chilled air flowing downwardly across the open front of the lower portion 20 and into the return opening 24 to continue the airflow pattern. As further shown by way of example in the illustrated embodiment, the upper portion 40 is convertible between a full-service mode with the front panel in the deployed position and a self-service mode with the front panel in a stowed position atop the upper portion. The upper portion 40 includes second refrigeration system components providing a second air-flow pattern 42 for the flow of refrigerated air that is drawn in through a return opening 44 by a second fan 46 and discharged through a second cooling coil 48 (e.g. evaporator, etc.) and distributed through an opening 50 into a second temperature controlled space 14 and then returned into the return opening 44 to continue the airflow pattern. According to another embodiment, the lower portion 20 may include a closed front, having doors or other suitable barriers to help maintain the temperature within the temperature controlled space. Although the upper portion 40 of the case is shown by way of example as including an evaporator coil and a fan, other types of cooling devices and technologies may be used to provide cooling to the food products in the temperature space, such as (for example) product support pans having a chilled coolant circulated therethrough to provide contact cooling to the products and/or gravity coils or serpentine coils disposed within an upper portion of the temperature controlled space, such as those described more particularly in U.S. Pat. Nos. 6,981,385 and 6,915,652, the complete disclosures of which are hereby incorporated by reference in their entirety. According to a further embodiment, the upper portion 40 may comprise a heated food display (in the manner of a "hot dome" or the like, in which the second refrigeration system components associated with the second airflow pattern are removed and replaced with heating elements to heat the food products displayed therein and thermal insulation is provided to thermally isolate the lower (refrigerated) portion 20 from the upper (heated) portion 40. According to yet another embodiment, the lower portion 20 may be excluded altogether and the upper portion 40 may be provided as a standalone temperature-controlled display device. All such embodiments and variations thereof are intended to be within the scope of this disclosure.

Figure 5:
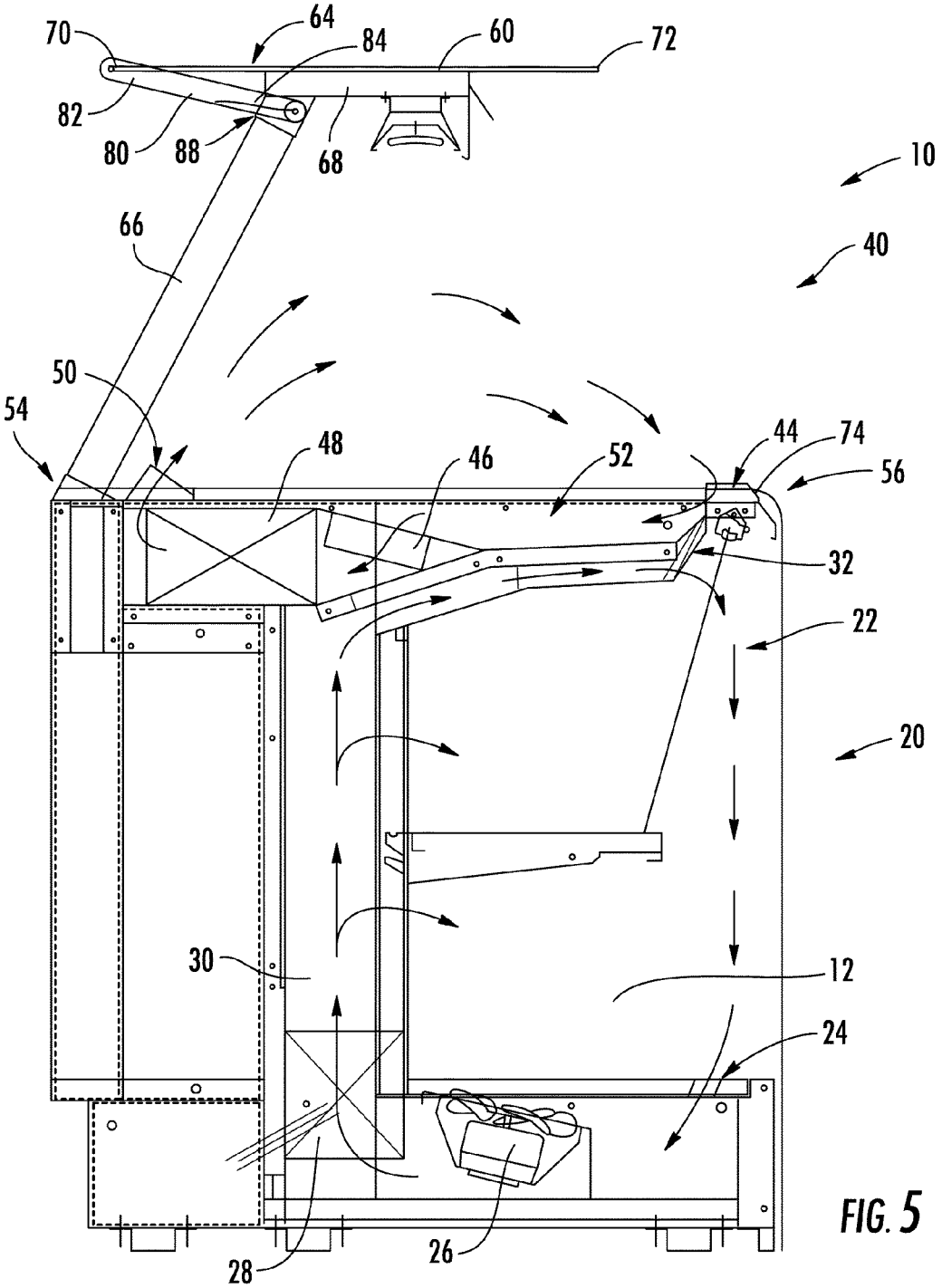
FIG. 5 is a schematic image of a side elevation view of the convertible temperature-controlled display device of FIG. 1 having the front panel disposed in a retracted (e.g. stowed) position corresponding to use in a self-service mode of operation.

Referring more particularly to the FIGURES, the upper portion 40 of the temperature-controlled display device 10 is shown to include features for converting between a full-service mode of operation (such as where service personnel tending to the case would access food products within the temperature controlled space 14 through doors or other suitable openings located on the back side of the case 10 at the request of customers typically located on a closed front side of the case 10) and a self-service mode of operation where such consumers would typically be capable of accessing the food products themselves directly through an open front side of the case 10. Case 10 includes a base portion 52 having a back side 54 and a front side 56 and is configured to support heated or refrigerated products in the temperature-controlled space 14, and also encloses heating elements and thermal insulation (not shown—for embodiments where the temperature controlled space is a heated space) or refrigeration system components (for embodiments where the temperature controlled space is a refrigerated space). Case 10 also includes a versatile front panel 60 that is readily movable between a deployed position 62 adjacent the front side 56 of the base 52 and across the front of the case 10 and corresponding to the full-service mode of operation (as shown in FIG. 1) and a retracted (or stowed) position 64 above or atop the upper portion 40 and corresponding to the self-service mode of operation (as shown in FIG. 5). The upper portion 40 includes a back frame member 66 (which may define or support doors or other suitable openings for accessing products during the full service mode), which supports a top frame 68, which may further support other components of the case (e.g. lighting components such as fluorescent or LED lighting, gravity-type cooling coils and drip pans, etc.).

Figure 2:
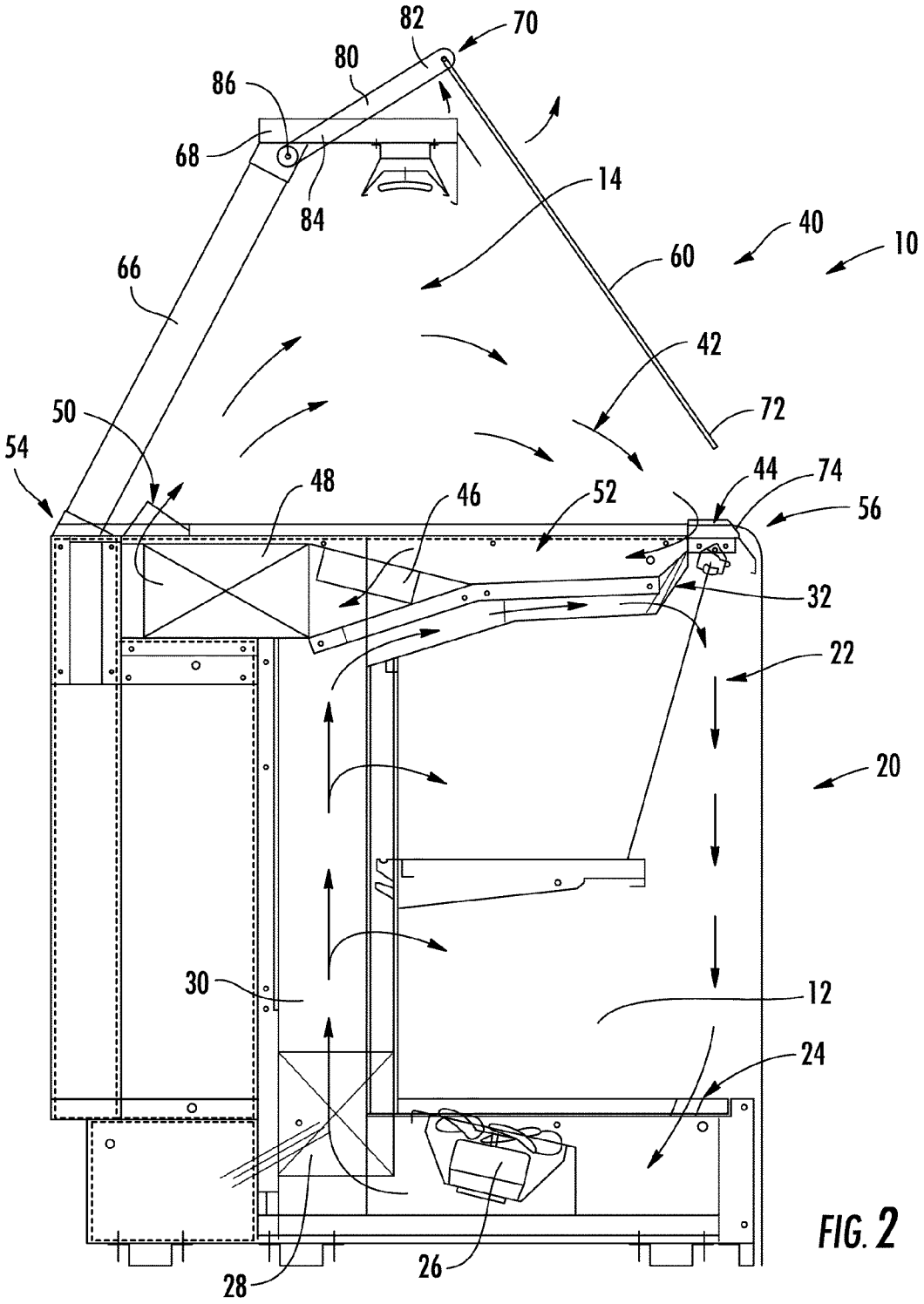
FIG. 2 is a schematic image of a side elevation view of the convertible temperature-controlled display device of FIG. 1 having the front panel disposed in a first position beginning a transition from a full-service mode to a self-service mode of operation.
Figure 3:
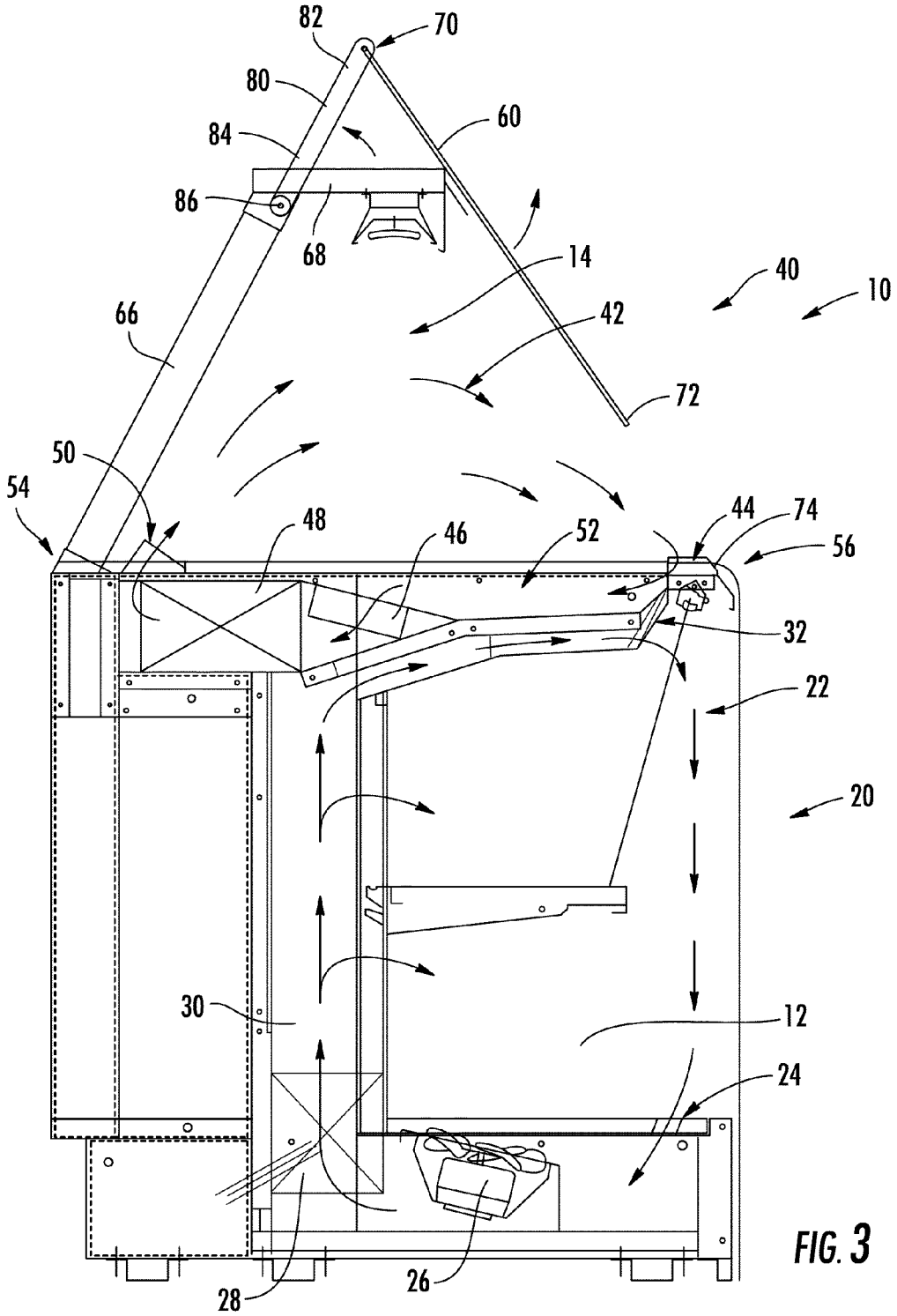
FIG. 3 is a schematic image of a side elevation view of the convertible temperature-controlled display device of FIG. 1 having the front panel disposed in a second position continuing the transition from a full-service mode to a self-service mode of operation.
Figure 4:
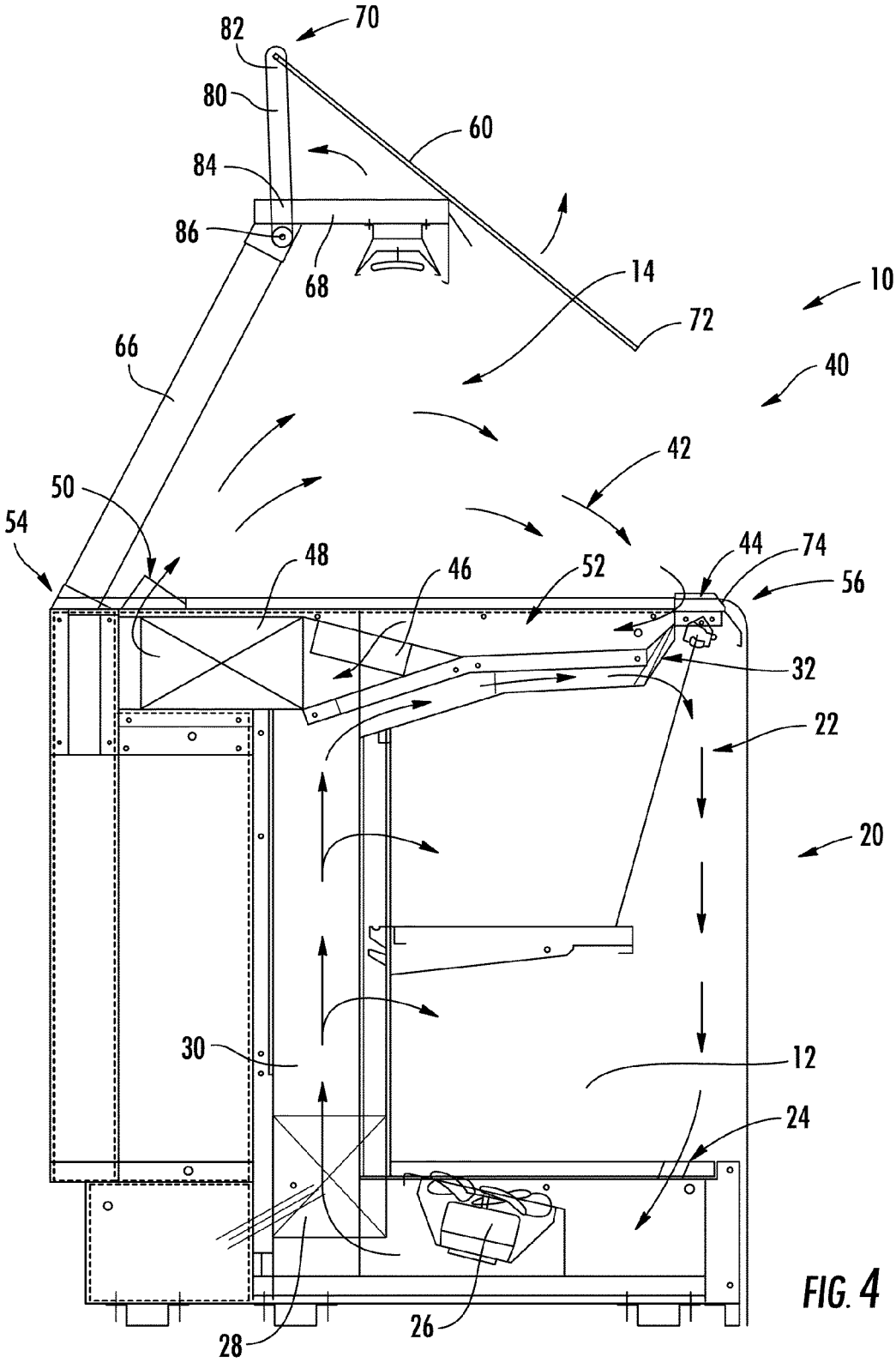
FIG. 4 is a schematic image of a side elevation view of the convertible temperature-controlled display device of FIG. 1 having the front panel disposed in a third position continuing the transition from a full-service mode to a self-service mode of operation.

Front panel 60 has a lower edge 72 that seats within a support ledge 74 or other suitable recess or receptacle along the front side 56 of the base 52 of the upper portion 40 which supports the front panel 60 when in the deployed position. Front panel 60 has an upper edge or portion 70 that is pivotally coupled at each end (e.g. by suitable posts or axles, etc.) to one or more linkage members 80 at a first end 82 (e.g. through suitable receptacles such as collars, bushings or the like). For example, one linkage member 80 may be provided at opposite lateral ends of the case 10 to support corresponding opposite lateral ends of the front panel 60, or additional intermediate linkages 80 may be provided, or the linkages 80 may be interconnected by a beam (not shown) that is hingedly coupled along at least part of the length of the top portion 70 of the front panel 60. Each linkage 80 has a second end 84 that is pivotally coupled at a pivot connection 86 to a rear end of the top frame 68 (or a top end of the back frame member 66 according to alternative embodiments). The linkages 80 have a length and pivot path such that the linkages 80 can be rotated upwardly (i.e. in a counter-clockwise direction according to the illustrations of FIGS. 2-4) beyond a front edge of the top frame and into a retracted (or stowed) position 64 shown with front panel 60 in a generally horizontal configuration supported by top frame 68 atop the upper portion 40 (as shown in FIG. 5). According to one embodiment, the front panel 60 in the stowed position 64 may also serve as a display platform for storing additional products or merchandise atop the upper portion 40. Referring further to FIG. 5, the back frame 66 may include a travel stop 88 (and may further include suitable dampers, dashpots, bumpers, cushions or the like—not shown) or other suitable structure intended to arrest and prevent further rotational movement of the front panel 60 once it reaches the stowed position 64. Also, according to any exemplary embodiment the convertible temperature-controlled display case may include features intended to help control or assist movement of the front panel between the deployed position and the stowed position. For example, the pivot connection 86 may also include a torsion spring or the like that is biased to assist in lifting the front panel upward from the deployed position to the stowed position (e.g. in the manner of a "garage door" spring or the like) and to provide a resistance that helps offset the weight of the front panel when lowered from the stowed position to the deployed position.

According to embodiments where the upper portion 40 of the case 10 provides a cold or refrigerated temperature-controlled space, the operation of the second refrigeration system may be configured to change when the front panel 60 is moved from the deployed position 62 to the stowed position 64 (and vice versa, i.e. from the stowed position 64 back to the deployed condition 62) in order to enhance operational efficiency and thermal performance of the upper portion 40 of the case 10 in each mode. For example, the second refrigeration system may be configured to operate with an increased airflow velocity at the return opening 44 when the front panel 60 is moved from the deployed (i.e. closed) position 62 to the stowed (i.e. open) position 64, in order to more effectively draw the chilled air from the temperature controlled space 14 across the open front and back to the second cooling coil 48. Alternatively, the refrigeration system may be configured to operate with a decreased airflow velocity at the return opening, in order to maintain a desired temperature of the food products during the self-service mode (i.e. with the front of the case in an open condition). According to one embodiment, such a change in airflow velocity (e.g. increasing or decreasing) may be accomplished by repositioning of a damper or louver or the like (not shown) within the airflow path. According to another embodiment, such a change in airflow velocity may be accomplished by changing a speed of the second fan 46. The change in operation of the second refrigeration system (e.g. positioning dampers, changing fan speeds, cooling coil temperature or operation, types or locations, etc.) may be accomplished manually or automatically. For example, a switch or pushbutton or the like may be provided that may be actuated by a user when the user manually repositions the front cover 60 from the deployed position 62 to the stowed position 64 (and vice versa). According to another example, operational change of the second refrigeration system may be accomplished automatically, such as through a position switch or other suitable sensor disposed at (or operationally adjacent to) the top frame 68 or the support ledge 74 or other suitable location such that upon moving the front panel 60 from the deployed position 62 to the stowed position 64 (or vice versa) the switch or sensor is deployed to also change operation of the second refrigeration system to the corresponding operational mode.

According to any exemplary embodiment, the versatile temperature-controlled display case 10 is convertible between a full-service mode and a self-service mode of operation. The case includes a base 52 configured to support temperature-controlled products (e.g. hot or cold food products, etc.), and a back frame 66 coupled to the base 52 and providing openings for back-side access of the food products during the full service mode, and a top frame 68 supported by the back frame 66. A movable front panel 60 is provided on a front side 56 of the case 10 and is movable between a deployed position 62 (across the front of the case 10 to close the front of the case 10, and corresponding to the full-service mode), and a retracted or stowed position 64 (adjacent the top of the case with the front open and corresponding to the self-service mode) for front-side access to the food products. The front panel 60 is coupled to a pivot linkage mechanism 80 that permits upward translational and rotational movement of the front panel 60 in front of the top frame to a position atop the top frame. Travel stops 88 and panel movement control or assist devices or mechanisms (e.g. springs, dampers, bumpers, etc.) may be provided to assist movement of the front panel 60. For embodiments where the temperature controlled products are heated food products, suitable heating elements and controls are provided within the base 52 to maintain a desired temperature of the hot food products, and thermal insulation is provided to thermally isolate the heating elements and the temperature controlled space 14 from adjacent devices (such as a separate refrigerated portion disposed beneath the base). For embodiments where the temperature controlled products are refrigerated food products, a refrigeration system (e.g. cooling coil, fan and airflow circuit, etc.) is adaptable manually or automatically to change operating modes or characteristics corresponding to the different environments created in the temperature-controlled space 14 when the front panel 60 is moved from the deployed position 62 to the stowed position 64 (or vice versa). Such a change in operating mode may be accomplished by a switch or the like manually activated by a user, or may be accomplished automatically by a suitable sensor positioned and configured to detect movement of the panel 60 (e.g. at the support ledge 74 to detect when the front panel is, and is not, in the deployed position 62).

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims. Moreover, all ranges disclosed herein are to be understood to encompass any and all subranges subsumed therein. For example, a stated range of 1 to 10 should be considered to include any and all subranges between and inclusive of the minimum value of 1 and the maximum value of 10; that is, all subranges beginning with a minimum value of 1 or more and ending with a maximum value of 10 or less (e.g., 5.5 to 10).

As used herein, spatial or directional terms, such as "left," "right," "front," "back," and the like, relate to the subject matter as it is shown in the drawing FIGS. However, it is to be understood that the subject matter described herein may assume various alternative orientations and, accordingly, such terms are not to be considered as limiting. Furthermore, as used herein (i.e., in the claims and the specification), articles such as "the," "a," and "an" can connote the singular or plural. Also, as used herein, the word "or" when used without a preceding "either" (or other similar language indicating that "or" is unequivocally meant to be exclusive—e.g., only one of x or y, etc.) shall be interpreted to be inclusive (e.g., "x or y" means one or both x or y). Likewise, as used herein, the term "and/or" shall also be interpreted to be inclusive (e.g., "x and/or y" means one or both x or y). In situations where "and/or" or "or" are used as a conjunction for a group of three or more items, the group should be interpreted to include one item alone, all of the items together, or any combination or number of the items. Moreover, terms used in the specification and claims such as have, having, include, and including should be construed to be synonymous with the terms comprise and comprising.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

It should be noted that the orientation of various elements may differ according to other exemplary embodiments, and that such variations are intended to be encompassed by the present disclosure.

No claim element herein is to be construed under the provisions of 35 U.S.C. §112, sixth paragraph, unless the element is expressly recited using the phrase "means for." Furthermore, no element, component or method step in the present disclosure is intended to be dedicated to the public, regardless of whether the element, component or method step is explicitly recited in the claims.

It is also important to note that the construction and arrangement of the convertible temperature-controlled display case as shown in the various exemplary embodiments is illustrative only. Although only a few embodiments of the present inventions have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter disclosed herein. For example, elements shown as integrally formed may be constructed of multiple parts or elements, the position of elements may be reversed or otherwise varied, and the nature or number of discrete elements or positions may be altered or varied. Accordingly, all such modifications are intended to be included within the scope of the present invention as defined in the appended claims. The order or sequence of any process or method steps may be varied or re-sequenced according to alternative embodiments. Other substitutions, modifications, changes and omissions may be made in the design, operating conditions and arrangement of the various exemplary embodiments without departing from the scope of the present inventions.

What is claimed is:

1. A temperature-controlled display case convertible for operation in a full-service mode and a self-service mode, the temperature-controlled display case defining a temperature-controlled space therein and comprising:

a base having a back side and a front side, and configured to support temperature-controlled food products within the temperature-controlled space;

a back frame coupled adjacent to the back side of the base and providing one or more openings configured to provide back side access to the food products during the full-service mode;

a top frame supported by the back frame;

a linkage having one end pivotally coupled to one of the back frame and the top frame;

a front panel having a top portion pivotally coupled to an opposite end of the linkage and movable between a deployed position for the full-service mode with the front panel adjacent to the front side of the base, and a stowed position for the self-service mode with the front panel disposed atop the top frame to provide front side access to the food products.

2. The temperature-controlled display case of claim 1, wherein the food products comprise heated food products and wherein the base further comprises heating elements and thermal insulation configured to maintain a temperature of the hot food products.

3. The temperature-controlled display case of claim 1, wherein the food products comprise refrigerated food products and wherein the base further comprises a cooling coil and a fan configured to circulate refrigerated air through the temperature-controlled space.

4. The temperature-controlled display case of claim 3, further comprising a switch operable to change a speed of the fan or an operating condition of the cooling coil when the front panel is moved from one of the deployed position or the stowed position to the other of the deployed position or the stowed position.

5. The temperature-controlled display case of claim 4, wherein the switch is configured to be operated automatically upon movement of the front panel.

6. The temperature-controlled display case of claim 1, wherein the front panel provides a substantially horizontal display platform supported by the top frame in the stowed position.

7. The temperature-controlled display case of claim 1, further comprising a torsion spring operably associated with the linkage to assist upward movement of the front panel and to resist downward movement of the front panel.

8. The temperature-controlled display case of claim 1, wherein the base, the back frame, the top frame and the front panel are all disposed within an upper portion, and the upper portion is disposed upon a lower portion, the lower portion comprising another temperature controlled space that is independent from the first temperature controlled space.

9. A temperature-controlled display case convertible for operation in a back-access mode and a front-access mode, the temperature-controlled display case defining a temperature-controlled space therein and comprising:

a base having a back side and a front side, and configured to support temperature-controlled products within the temperature-controlled space;

a back frame from the base;

a top frame supported by the back frame;

a pivot member having one end coupled to at least one of the back frame and the top frame;

a front panel having a top portion pivotally coupled to the pivot member and movable between a deployed position with the front panel enclosing the front side of the base, and a stowed position for the front-access mode with the front panel disposed atop the top frame to provide front side access to the food products.

10. The temperature-controlled display case of claim 9, wherein the food products comprise heated food products and wherein the base further comprises heating elements and thermal insulation configured to maintain a temperature of the hot food products.

11. The temperature-controlled display case of claim 9, wherein the food products comprise refrigerated food products and wherein the base further comprises a cooling coil and a fan configured to circulate refrigerated air through the temperature-controlled space.

12. The temperature-controlled display case of claim 11, further comprising a switch operable to change a speed of the fan or an operating condition of the cooling coil when the front panel is moved from one of the deployed position or the stowed position to the other of the deployed position or the stowed position.

13. The temperature-controlled display case of claim 12, wherein the switch is configured to be operated automatically upon movement of the front panel.

14. The temperature-controlled display case of claim 9, wherein the front panel provides a substantially horizontal display platform supported by the top frame in the stowed position.

15. The temperature-controlled display case of claim 9, further comprising a torsion spring operably associated with the linkage to assist upward movement of the front panel and to resist downward movement of the front panel.

16. The temperature-controlled display case of claim 9, wherein the base, the back frame, the top frame and the front panel are all disposed within an upper portion, and the upper portion is disposed upon a lower portion, the lower portion comprising another temperature controlled space that is independent from the first temperature controlled space.

17. A method of providing a temperature-controlled display case convertible for operation in a full-service mode and a self-service mode, comprising:

providing a base having a back side and a front side;

providing a back frame coupled to the base and having one or more openings configured to provide back side access to the food products during the full-service mode;

providing a top frame supported by the back frame;

providing a linkage having one end pivotally coupled to at least one of the back frame and the top frame;

pivotally coupling a top portion of a front panel to an opposite end of the linkage, so that the top panel is movable between a deployed position for the full-service mode with the front panel adjacent to the front side of the base, and a stowed position for the self-service mode with the front panel disposed above the top frame to provide front side access to the food products.

* * * * *